United States Patent [19]

Chupka

[11] 4,451,358

[45] May 29, 1984

[54] NONCIRCULAR REJECTS OUTLET FOR CYCLONE SEPARATOR

[75] Inventor: David E. Chupka, Middletown, Ohio

[73] Assignee: The Black Clawson Company, Middletown, Ohio

[21] Appl. No.: 531,191

[22] Filed: Sep. 12, 1983

Related U.S. Application Data

[63] Continuation of Ser. No. 322,831, Nov. 19, 1981, abandoned.

[51] Int. Cl.[3] ..... B04C 5/14

[52] U.S. Cl. ..... 209/144; 209/211

[58] Field of Search ..... 209/144, 211; 210/512.1; 239/601

[56] References Cited

U.S. PATENT DOCUMENTS

| | | | |
|---|---|---|---|
| 1,130,802 | 3/1915 | Crippen | 239/601 |
| 1,595,258 | 8/1926 | Stebbins | 209/144 |
| 1,668,271 | 5/1928 | Fisk | 239/601 |
| 1,861,247 | 5/1932 | Stebbins | 209/144 |
| 1,982,733 | 12/1933 | Forster | 209/144 |
| 2,425,710 | 8/1947 | Bucknam et al. | 239/601 |
| 2,573,192 | 10/1951 | Fontein | 209/211 |
| 2,897,972 | 8/1959 | Cannon | 209/211 |
| 2,913,112 | 11/1959 | Stavenger et al. | 209/211 |
| 2,985,384 | 5/1961 | Martin | 239/601 |
| 2,999,593 | 9/1961 | Stem | 209/211 |
| 3,042,203 | 7/1962 | Clute | 209/144 |
| 3,724,674 | 4/1973 | Loison | 210/512.1 |
| 3,800,946 | 4/1974 | Reid et al. | 209/144 |
| 3,971,718 | 7/1976 | Reid | 209/144 |
| 4,203,834 | 5/1980 | Martin | 209/211 |
| 4,216,913 | 8/1980 | Troup | 239/601 |
| 4,224,145 | 9/1980 | Skardal | 209/211 |

FOREIGN PATENT DOCUMENTS

| | | | |
|---|---|---|---|
| 531112 | 4/1954 | Belgium | 209/144 |

*Primary Examiner*—Tim R. Miles

*Attorney, Agent, or Firm*—Biebel, French & Nauman

[57] ABSTRACT

The use of rejects outlets in vortex separators having internal walls which gradually transform from a circular cross-section into openings which are noncircular in cross-section has been found to be effective in controlling the rejects rate and the thickening factor of the separators while maintaining effective cleaning efficiencies without plugging problems. The rejects outlets may be fabricated as replaceable tips or may be integrally formed with the cyclone bodies.

9 Claims, 10 Drawing Figures

NONCIRCULAR REJECTS OUTLET FOR CYCLONE SEPARATOR

This is a continuation of Ser. No. 322,831, filed Nov. 19, 1981 and now abandoned.

BACKGROUND OF THE INVENTION

The present invention relates to apparatus for separating suspensions of solid particles in fluids, including both gases and liquids, into light and heavy fractions, and in particular to the separation of undesired particles from paper pulp slurries.

The use of vortex or cyclone cleaners for separating sand, grit, bark particles, and shives from cellulose fibers in a paper pulp slurry is now well known. In general, such cleaners include an elongated chamber of circular cross-section, either cylindrically shaped or somewhat tapered. The pulp slurry to be cleaned is introduced under pressure into one end of the chamber through a restricted tangential inlet so that a high velocity vortex is developed along the length of the chamber. The vortex is typically of a velocity high enough to form a centrally-located axial gas core in the chamber. The end of the chamber opposite the inlet is tapered and forms a relatively small diameter apex discharge outlet for the denser and larger particle rejects portion of the pulp slurry. Acceptable fibers, which are of a relatively lower density and are located near the inner portion of the vortex, reverse their direction of flow adjacent the tapered end of the chamber and flow upwardly to be withdrawn through an axial outlet at the larger diameter end of the chamber.

Generally, a cyclone separator system includes several stages coupled in series, with each stage including several separators connected in parallel, having common inlet and outlet chambers. The second stage treats the rejects of the first, the third stage treats the rejects of the second, and so on, in an effort to minimize the amount of discarded good fibers while concentrating the impurities. Such a system is utilized to separate the original highly diluted pulp suspension into a usable paper making fiber portion (a lower density accepts portion) and a thickened large and denser impurities portion (rejects). An increase in the rejects flow from a cyclone separator system can result in the more complete removal of contaminants and impurities from the pulp suspension. However, increased rejects flows result in greater power requirements for the system to handle and transport greater volumes of material. Additionally, increased rejects flows increase the amount of good fiber which is discarded from the system.

However, the smaller the diameter of the rejects outlet of a separator, the more susceptible it becomes to plugging and clogging with impurities. Many attempts have been made to solve the problems of controlling fiber loss and plugging of rejects discharge outlets. Some have supplied water under pressure to dilute the heavy rejects fraction and wash out good paper making fibers. Others have utilized special valving arrangements to control the flow of rejects through the discharge outlet. Examples of this type of attempted solution include Jakobsson et al, U.S. Pat. No. 3,696,927 and Skardal, U.S. Pat. No. 3,277,926. Still others have utilized grooves, ledges, and guide bars positioned in the tapered portion of cyclone chambers to control the flow of rejects. Examples of this type of attempted solution include Reid, U.S. Pat. No. 3,971,718, Frykult, U.S. Pat. No. 4,153,558, Skardal, U.S. Pat. No. 4,156,485, and Skardal, U.S. Pat. No. 4,224,145.

These attempts have at best been only partially successful in solving plugging problems and reducing fiber losses. Accordingly, the need still exists in the art for a cyclone separation device which is efficient, not subject to plugging problems, and which minimizes good paper-making fiber losses through the rejects discharge outlet.

SUMMARY OF THE INVENTION

The present invention meets that need by providing a cyclone separation device in which the internal wall of the device gradually transforms from a circular cross-section into a rejects discharge outlet which is noncircular in cross-section. It has been discovered that by varying the shape of the rejects outlet of a cyclone separator, the rejects rate, the thickening factor, and the feed pressure to the device can also be varied while maintaining substantially the same cleaning efficiency without plugging problems. The modified rejects outlet of the present invention may be incorporated or formed as an integral part of a conventional cyclone separation device or may be fabricated as a replaceable tip. Additionally, the present invention may be utilized in both single separator devices as well as in clusters of such devices. The modified rejects outlet of the present invention may also be used in conjunction with reverse centrifugal cleaning devices such as the device taught in Seifert et al, U.S. Pat. No. 4,155,839. Finally, the present invention may also be utilized in the separation of solids from gases.

By modifying the rejects outlet into a noncircular configuration, a number of operational advantages may be achieved. These include:

1. Significantly reduced rejects rates, i.e., the percentage of fiber in the rejects compared with the feed stock, without plugging, minimizing the loss of good fibers from the cleaner;
2. A greater accepts consistency as compared with a standard circular outlet, when a square configuration is used;
3. Greater thickening factor, i.e., the ratio rejects consistency to feed consistency, when an oval or oblong outlet configuration is used;
4. Satisfactory operation at lower feed pressures than with standard circular outlets;
5. Ability to handle more volumetric feedstock flow; and
6. Ability to utilize substantially larger outlet openings, which are less likely to plug, and still maintain substantially the same rejects rate as conventional circular rejects outlets.

Surprisingly, the cleaning efficiency of cyclone separators using the present invention is substantially unaffected by the noncircular rejects outlets. This provides flexibility in the design of such cyclone separator systems to achieve one or more of the above operational advantages at no sacrifice in cleaning efficiency.

Accordingly, it is an object of the present invention to provide a cyclone separator device having a modified rejects outlet which is efficient, not subject to plugging problems, and which minimizes the losses of good paper making fibers from the rejects discharge outlet. This, and other objects and advantages of the invention will be apparent from the following description, the accompanying drawings, and the appended claims.

FIGS. *2a*, *3a*, *4a*, and *5a* are sectional side views of the respective rejects outlets; and FIG. *2b* is a sectional view taken along line *2b*—*2b* in FIG. *2a*.

DESCRIPTION OF THE PREFERRED EMBODIMENTS

Figure 1:
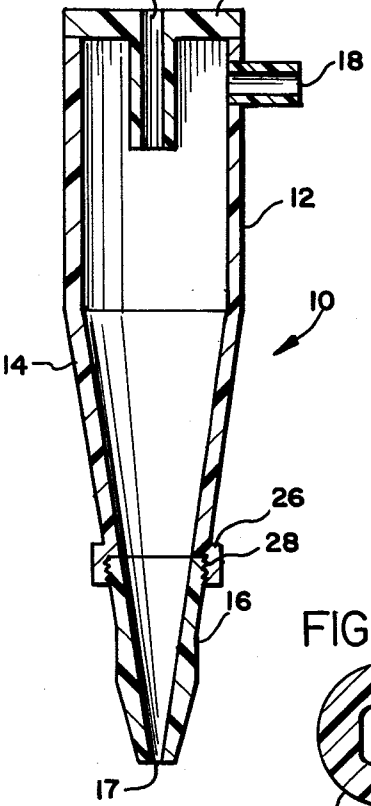
FIG. 1 is a sectional view of a typical cyclone separator having a rejects outlet.

Referring to FIG. 1, a typical cyclone separation device is illustrated. Of course, the invention is not limited to single devices including reverse centrifugal cleaning devices but is equally applicable to cluster arrangements. The apparatus includes a hollow cyclone member 10 forming a separation chamber having a cylindrical portion 12, a tapering portion 14, and a hollow apex cone or tip portion 16 which has an outlet port 17. The cylindrical and tapering portions of the cyclone body may be formed of a polymeric resin material such as polypropylene, polystyrene, nylon, or the like. The apex tip portion 16 is preferably formed of a ceramic material which resists abrasion, although it may also be formed as a unitary structure with the cyclone body out of the same material as the body is formed.

The cylindrical portion 12 of the cyclone has a tangentially extending slot-like inlet 18 through which a fluid suspension of material, such as paper stock, will enter the apparatus. The end of cylindrical portion 12 of the cyclone body is provided with a closure cover 20 which may be fabricated of the same polymeric resin material as other portions of cyclone member 10. Closure cover 20 and the end of cylindrical portion 12 may be threaded for sealing engagement. Closure cover 20 is also provided with a centrally located vortex finder or overflow nozzle tube 22 through which the accepts portion of the suspension flows and which extends inwardly into the center of cylindrical portion 12.

Cyclone member 10 includes an apex tip portion 16 which is preferably formed of an abrasion resistant cast ceramic material. The tapering tip portion 16 forms an extension of tapering portion 14, and can be formed with an outwardly projecting threaded portion 26 as an original part thereof for receiving an annular internally threaded coupling nut 28 to seal tip portion 16 to tapering portion 14. Alternatively, the threaded portion may be cemented in place on the tip portion 16 in a known manner.

Figure 2:
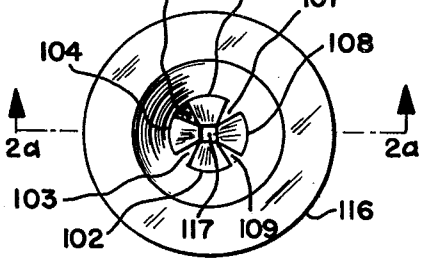
Figure 2A:
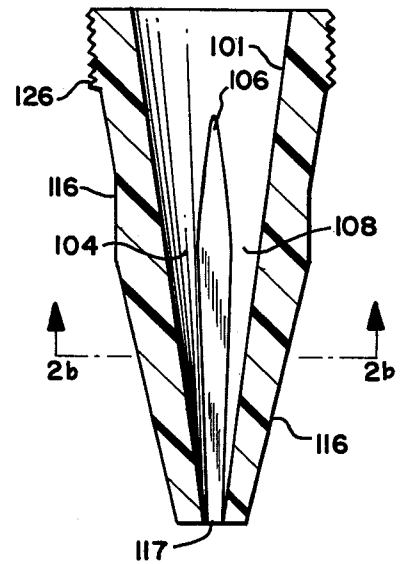
Figure 2B:
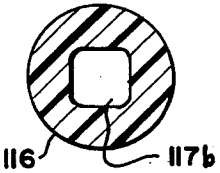

FIGS. 2, *2a* and *2b* illustrate an embodiment of the invention in which apex tip portion 116 has an outlet port 117 having a square cross-section. As shown, apex tip 116 is designed to be a replaceable element which can be joined to a cyclone separator body using threads 126.

As shown in FIGS. 2, *2a*, and *2b*, the inner wall 101 of the hollow tapering body portion of apex tip 116 gradually transforms from circular to square cross-section a portion of the distance along the length of the tip. Tapering wall portions 102, 104, 106, and 108, which together form a tapered passageway having a square cross-section, may be integrally molded into apex tip 116 during its fabrication (as illustrated) or may be secured in position after formation of the apex tip by suitable means. It has been found that the performance of the tip, which is improved by the use of an outlet of noncircular cross-section, is even further enhanced when at least a portion of the inner wall of the tip leading to the outlet gradually assumes the same cross-sectional configuration as the outlet, as best shown in FIG. *2b*, where opening 117*b* has started to assume a square cross-section. The exact amount and angle of taper will depend on many factors including the initial size and diameter of the cyclone separator and the desired cross-sectional area of the outlet opening.

It will of course be recognized that different portions of inner wall 101 will have differing angles of taper. That is, as the cross-section of the separator is gradually transformed from circular to noncircular, certain wall portions will form lesser angles with the longitudinal axis of separator than other wall portions. For example, as illustrated in FIGS. 2, *2a*, and *2b*, tapering wall portions 102, 104, 106, 108 will form lesser angles with the longitudinal axis of the separator than the wall portions 103, 105, 107 and 109 which are located between the tapering wall portions.

On the other hand, if a different manufacturing process is utilized and certain portions of the inner wall of the separator are removed, for example, to produce a nominal 5/16" square outlet from the same diameter circular outlet, then the inner wall portions located along lines ending at each of the four corners of the finished outlet will form greater angles with the longitudinal axis of the separator than other wall portions since portions of the inner wall will be removed. When it is stated in this specification that the internal wall of the separator gradually transforms from a circular to a noncircular configuration, that expression is meant to cover both of the situations described above.

Figure 3:
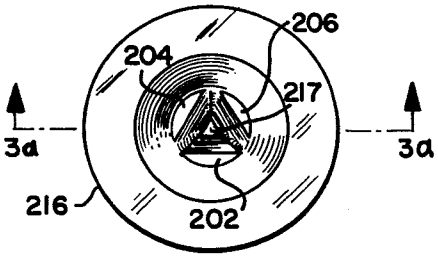
FIGS. 2, 3, 4 and 5 are top elevational views looking down into cyclone separator rejects outlets.
Figure 3A:
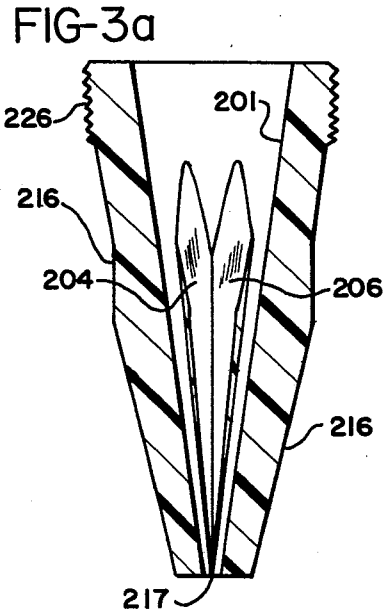

In another embodiment of the invention illustrated in FIGS. 3 and *3a*, apex tip portion 216 has an outlet portion 217 having a triangular cross-section. Tip 216, as shown, is designed to be joined to a cyclone body using threads 226. Inner wall 201 of tip 216 changes from a circular to a triangular cross-section a portion of the distance along the length of the tip. Tapering wall portions 202, 204, and 206 are provided which together form a tapering passageway having a triangular cross-section.

Figure 4:
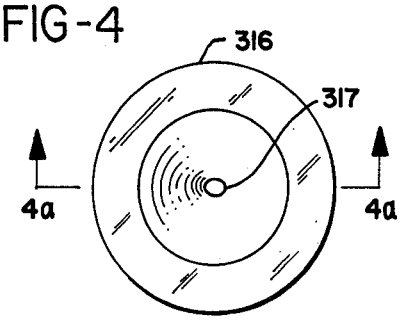

The embodiment of the invention shown in FIGS. 4 and *4a* illustrates the use of an oblong or elliptical outlet port 317 in apex tip 316. The elliptically-shaped outlet results from the formation of the end of tip 316 at an angle from the axis normal to the long axis of the tip. The angle may be varied from 1° to 89° to vary the extent that outlet portion 317 deviates from a circular cross-section. Alternatively, the tip 316 may be formed with an elliptically-shaped outlet having an end normal to the long axis of the tip. As before, tip 316 may include threads 326 to secure it to a cyclone body.

Figure 5:
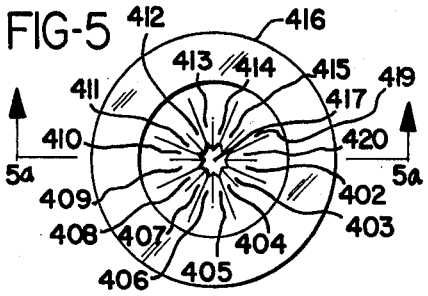
Figure 4A:
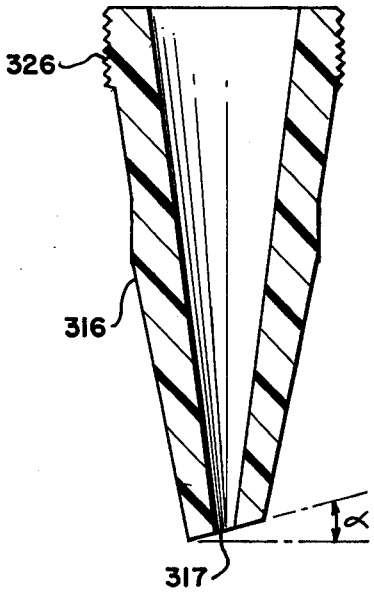
Figure 5A:
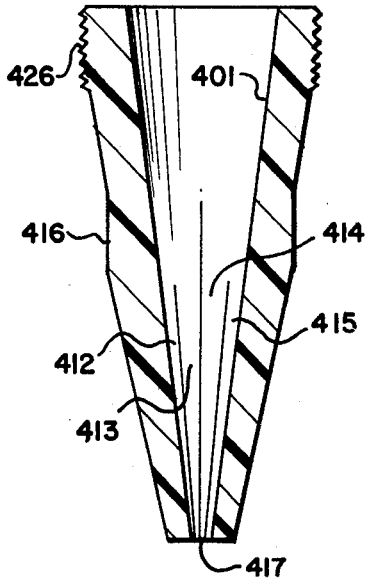

The embodiment of the invention shown in FIGS. 5 and *5a* illustrates the use of a polygonal or saw-toothed shaped outlet portion 417 in an apex tip 416 designed to be joined to a cyclone body using threads 426. Inner wall 401 of tip 416 changes from a circular to a polygonal cross-section a portion of the distance along the length of the tip. Tapering wall portions 402, 403, 404, 405, 406, 407, 408, 409, 410, 411, 412, 413, 414, 415, 419 and 420 together form a tapering passageway having a polygonal cross-section and giving a saw-toothed effect to the outlet 417.

In order that the invention may be better understood, reference is made to the following nonlimiting examples.

EXAMPLE 1

Several tests were run using as the feedstock a deink stock from the third stage rejects of a cyclone separator system. A 3" diameter Cellu-Clone cyclone cleaner, available from The Black Clawson Company, Middletown, Ohio, was used for the tests. Four different rejects tips were tested as follows:

1. Standard tip-circular cross-section, 0.36" diameter (0.103 sq. in. open area)
2. Tip A—circular cross-section, 0.25" diameter (0.049 sq. in. open area)
3. Tip B—square cross-section, 0.25" sides, tapered (0.063 sq. in. open area)
4. Tip C—oblong cross-section, 0.173"×0.365" (0.063 sq. in. open area).

The results are reported in Table I below. In Runs 1–4, reject flow was controlled by a reject valve present in the cyclone separator device. Runs 5–8 were performed with the reject valve wide open to eliminate any possibility of plugging of the valve. An arrangement to provide free discharge was set up so that the rejects from the device discharged into an open pipe located approximately 8 feet above the device. This arrangement provided approximately 3.5 psi back pressure on the reject stock. The pressure drop measured through the device was 20 psi for all runs.

TABLE I

| Run | Reject Tip | Consistency Feed (Calc.) | Consistency Accept | Consistency Reject | Flow Rates, GPM Feed | Flow Rates, GPM Accept | Flow Rates, GPM Reject | Pulp Flow, O.D. T/D Feed | Pulp Flow, O.D. T/D Accept | Pulp Flow, O.D. T/D Reject | Inlet Pressure (PSI) | Reject Rate % BOP | Temp. °F. | Thickening Factor |
|---|---|---|---|---|---|---|---|---|---|---|---|---|---|---|
| 1 | STD | 0.71 | 0.61 | 3.29 | 44.0 | 42.4 | 1.6 | 1.87 | 1.55 | .32 | 35 | 17.1% | 88 | 4.63 |
| 2 | A | 0.56 | 0.51 | 2.88 | 44.0 | 43.1 | .9 | 1.48 | 1.32 | .16 | 35 | 10.8% | 99 | 5.14 |
| 3 | B | 0.59 | 0.56 | 2.38 | 43.0 | 42.34 | .66 | 1.51 | 1.42 | .09 | 35 | 6.0% | 100 | 4.03 |
| 4 | C | 0.55 | 0.47 | 3.28 | 44.0 | 42.7 | 1.3 | 1.46 | 1.20 | .26 | 35 | 17.8% | 115 | 5.96 |
| 5 | STD | 0.62 | 0.52 | 2.99 | 42.0 | 40.3 | .7 | 1.57 | 1.26 | .31 | 34 | 19.8% | 76 | 4.82 |
| 6 | A | 0.59 | 0.55 | 2.85 | 42.0 | 41.38 | .62 | 1.48 | 1.37 | .11 | 35 | 7.4% | 84 | 4.83 |
| 7 | B | 0.59 | 0.57 | 2.30 | 44.0 | 43.56 | .44 | 1.55 | 1.49 | .06 | 28 | 3.9% | 86 | 3.90 |
| 8 | C | 0.55 | 0.52 | 3.10 | 43.0 | 42.46 | .54 | 1.43 | 1.33 | .10 | 32 | 7.0% | 87 | 5.64 |

As can be seen, Runs 3 and 7 performed with square tip B resulted in significantly lower reject rates and thickening factors than the standard circular tip (Runs 1 and 5) or tip A (Runs 2 and 6). Visual observation indicated that cleaning efficiency was substantially the same for all tips. No plugging of any tips occurred. Oblong tip C (Runs 4 and 8) exhibited a significantly greater thickening factor indicating its utility in situations where a higher consistency rejects stream is desired.

EXAMPLE 2

The same arrangement as in Example 1 was used to test the tips except that the feedstock utilized was a mixture of Kraft corrugated furnish, clippings, and pieces. The results are reported in Table II below. Again, the pressure drop through the device was measured to be 20 psi for all runs.

TABLE II

| Run | Reject Tip | Consistency Feed (Calc.) | Consistency Accept | Consistency Reject | Flow Rates, GPM Feed | Flow Rates, GPM Accept | Flow Rates, GPM Reject | Pulp Flow, O.D. T/D Feed | Pulp Flow, O.D. T/D Accept | Pulp Flow, O.D. T/D Reject | Inlet Pressure (PSI) | Reject Rate % BOP | Temp. °F. | Thickening Factor |
|---|---|---|---|---|---|---|---|---|---|---|---|---|---|---|
| 9 | STD | 0.53 | 0.50 | 1.52 | 46 | 44.6 | 1.4 | 1.47 | 1.34 | .13 | 32 | 8.9% | 80 | 2.87 |
| 10 | B | 0.55 | 0.54 | 1.60 | 48 | 47.5 | .5 | 1.59 | 1.54 | .05 | 25½ | 3.2% | 87 | 2.90 |
| 11 | C | 0.51 | 0.49 | 1.70 | 48 | 47.3 | .7 | 1.46 | 1.39 | .07 | 29 | 4.9% | 92 | 3.33 |

Again, square tip B (Run 10) operated at significantly lower reject rate than the standard circular tip (Run 9). No plugging occurred, and cleaning efficiencies for all tips appeared to be substantially the same. As before, oblong tip C (Run 11) exhibited a significantly higher thickening factor than the standard circular tip.

EXAMPLE 3

Further test runs were made using the feedstock of Example 1 at a higher consistency (i.e., approximately 1.0%). The results are reported in Table III below. The pressure drop measured through the device was 20 psi, for all runs.

TABLE III

| Run | Reject Tip | Consistency Feed (Calc.) | Consistency Accept | Consistency Reject | Flow Rates, GPM Feed | Flow Rates, GPM Accept | Flow Rates, GPM Reject | Pulp Flow, O.D. T/D Feed | Pulp Flow, O.D. T/D Accept | Pulp Flow, O.D. T/D Reject | Inlet Pressure (PSI) | Reject Rate % BOP | Temp. °F. | Thickening Factor |
|---|---|---|---|---|---|---|---|---|---|---|---|---|---|---|
| 12 | B | 0.93 | 0.92 | 2.32 | 42 | 41.7 | .3 | 2.34 | 2.30 | .04 | 28 | 1.8% | 64 | 2.50 |
| 13 | STD | 0.86 | 0.82 | 2.88 | 43 | 42.06 | .94 | 2.23 | 2.07 | .16 | 32 | 7.3% | 70 | 3.35 |
| 14 | C | 0.99 | 0.96 | 3.08 | 42 | 41.4 | .6 | 2.49 | 2.38 | .11 | 31 | 4.5% | 66 | 3.11 |
| 15 | STD | 0.93 | 0.89 | 2.95 | 42 | 41.16 | .84 | 2.35 | 2.20 | .15 | 32 | 6.3% | 70 | 3.17 |

Again, even at higher feed consistencies, the square tip B (Run 12) exhibited a significantly lower reject rate as well as a lower thickening factor. Again, no plugging was observed.

EXAMPLE 4

Further test runs were made using the feedstock of Example 1. A new tip was also tested as follows:

Tip D—square cross-section, 0.25" sides, no taper (0.063 sq. in. open area)

By "no taper" it is meant that the walls of the tip were parallel, rather than tapering inwardly. In later runs (Runs 19 and 22), tip D was modified to give it tapered walls much like tip B. The results of the tests are reported in Table IV below. The pressure drop through the device was measured to be 20 psi for all runs.

TABLE IV

| Run | Reject Tip | Consistency Feed (Calc.) | Consistency Accept | Consistency Reject | Flow Rates, GPM Feed | Flow Rates, GPM Accept | Flow Rates, GPM Reject | Pulp Flow, O.D. T/D Feed | Pulp Flow, O.D. T/D Accept | Pulp Flow, O.D. T/D Reject | Pressure Drop | Reject Rate % BOP | Temp. °F. | Thickening Factor |
|---|---|---|---|---|---|---|---|---|---|---|---|---|---|---|
| 16 | D | 0.55 | 0.45 | 3.75 | 44 | 42.75 | 1.25 | 1.43 | 1.15 | .28 | 35 | 19.5% | 96 | 6.8 |
| 17 | B | 0.55 | 0.50 | 3.08 | 44 | 43.23 | .77 | 1.44 | 1.30 | .14 | 31 | 9.7% | 96 | 5.6 |
| 18 | B | 0.56 | 0.53 | 2.98 | 44 | 43.42 | .58 | 1.48 | 1.38 | .10 | 30 | 7.0% | 103 | 5.3 |
| 19 (modified) | D | 0.56 | 0.52 | 2.21 | 44 | 42.9 | 1.10 | 1.49 | 1.34 | .15 | 30 | 9.8% | 80 | 3.95 |
| 20 | B | 0.52 | 0.49 | 2.50 | 44 | 43.3 | .7 | 1.38 | 1.27 | .11 | 30½ | 7.6% | 95 | 4.81 |
| 21 | STD | 0.48 | 0.35 | 2.95 | 44 | 41.8 | 2.2 | 1.27 | .88 | .39 | 37 | 30.7% | 106 | 6.15 |
| 22 (modified) | D | 0.50 | 0.46 | 2.43 | 44 | 43.1 | .9 | 1.32 | 1.19 | .13 | 30½ | 9.8% | 115 | 4.86 |

The tests show the improved operating performance when using tapered sides in a square tip (Runs 17, 18, 19, 20 and 22) versus no taper (Run 16). However, the no taper tip D (Run 16) still operated at a lower reject rate than the standard circular tip (Run 21). Thickening factors were again lower for square versus circular tips. No plugging occurred.

Thus, by utilizing a rejects outlet of noncircular cross-section in a cyclone separator as taught by the present invention, the rejects rate, thickening factor, and feed pressure to the device can also be varied to yield improved performance of the device while maintaining substantially the same cleaning efficiency and without plugging problems. For example, a lower rejects rate can be obtained using the same open area for a square tip versus prior art circular tips. If plugging is a problem, larger open area square tips can be used at substantially the same reject rates as prior art circular tips. Other modifications of tip geometry will be readily apparent to the skilled practitioner to achieve optimum performance under varying conditions of feed, pressure, consistency, and the like.

While the apparatus herein described constitutes preferred embodiments of the invention, it is to be understood that the invention is not limited to this precise apparatus, and that changes may be made without departing from the scope of the invention, which is defined in the appended claims.

What is claimed is:

1. In a cyclone separator comprising means forming a separation chamber, a first end thereof having a generally circular cross-section and including a tangential inlet to said separation chamber through which a fluid suspension of material enters, and a central outlet therefrom through which the accepts portion of said fluid suspension exits said separation chamber, the opposite end of said separation chamber tapering toward an outlet of smaller flow area than said chamber through which the rejects portion of said fluid suspension exits said separation chamber, the improvement comprising wall means, said wall means including a plurality of tapering wall portions extending along the longitudinal axis of said separator which define an outlet having a non-circular cross-section, said outlet being continuously open during the operation of said separator.

2. The cyclone separator of claim 1 wherein said outlet has a triangular cross-section.

3. The cyclone separator of claim 1 wherein said outlet has a polygonal cross-section.

4. The cyclone separator of claim 1 wherein at least a portion of the internal wall of said opposite end of said separation chamber gradually transforms to the same cross-section as said outlet.

5. The cyclone separator of claim 1 in which alternate ones of said tapering wall portions form lesser angles with the longitudinal axis of said separator than adjacent tapering wall portions.

6. The cyclone separator of claim 1 wherein said outlet has a square cross-section.

7. The cyclone separator of claim 6 wherein at least a portion of the internal wall of said opposite end of said separation chamber gradually transforms to the same cross-section as said outlet.

8. The cyclone separator of claim 1 wherein said outlet has an oblong cross-section.

9. The cyclone separator of claim 8 in which said outlet is formed at an angle of between 1° and 89° from the axis normal to the longitudinal axis of said separator.

* * * * *